United States Patent [19]

Laprade et al.

[11] 4,079,713

[45] Mar. 21, 1978

[54] REFINEMENTS TO CONSTANT DEPRESSION CARBURETTORS

[76] Inventors: Bernard R. Laprade; Xavier J. Laprade, both of 64260 Arudy; Pierre J. Gele, 3, rue Vaussenat, Tarbes, all of France

[21] Appl. No.: 696,188

[22] Filed: Jun. 15, 1976

[30] Foreign Application Priority Data

Jun. 18, 1975 France ..... 75 19133

[51] Int. Cl.[2] ..... F02M 9/06

[52] U.S. Cl. ..... 123/119 EC; 261/44 C

[58] Field of Search ..... 123/32 EE, 119 EC; 60/285; 261/44 R, 44 C

[56] References Cited

U.S. PATENT DOCUMENTS

| | | | |
|---|---|---|---|
| 3,653,642 | 4/1972 | Lawrence | 261/44 R |
| 3,760,785 | 9/1973 | Harrison et al. | 261/65 |
| 3,807,172 | 4/1974 | Masaki | 60/285 |
| 3,855,974 | 12/1974 | Mayer | 123/32 EE |
| 3,927,649 | 12/1975 | Stumpp | 60/285 |
| 3,978,175 | 8/1976 | Stoltman | 261/69 R |

FOREIGN PATENT DOCUMENTS

| | | | |
|---|---|---|---|
| 25722/70 | 8/1966 | Japan | 261/44 R |
| 28728/71 | 12/1966 | Japan | 261/44 R |
| 30368/70 | 9/1966 | Japan | 261/44 R |
| 510,753 | 8/1939 | United Kingdom | 261/44 R |

*Primary Examiner*—Tim R. Miles

*Attorney, Agent, or Firm*—Finnegan, Henderson, Farabow & Garrett

[57] ABSTRACT

In a carburettor, the dosing needle for regulating the fuel flow is connected to a second movable element, such as a membrane or piston, the second movable element being movable relative to a first movable element, one side of the second movable element being subject to atmospheric pressure and the other side of the second movable element being subject to the partial vacuum prevailing upstream of the throttle valve, modulated by an electromagnetic valve capable of supplying atmospheric pressure, the electromagnetic valve being controlled by a probe arranged in the exhaust pipe which supplies a signal representative of the composition of the exhaust gases.

4 Claims, 2 Drawing Figures

REFINEMENTS TO CONSTANT DEPRESSION CARBURETTORS

BACKGROUND OF THE INVENTION

1. Field of the Invention

This invention relates to carburettors for internal combustion engines, more particularly to carburettors which are regulated as a function of the composition of the exhaust gases.

2. Description of the Prior Art

It is a known practice, in particular from French Patent Application No. 74.30009 filed on Sept. 4, 1974, now French Patent No. 2,284,004, and French Patent Application No. 72.46845 of Dec. 29, 1972, now French Patent No. 2,174,501 constant vacuum carburettor provided with means of regulation as a function of the composition of the exhaust gases. According to Patent Application No. 74.30009 in particular, the partial vacuum transmitted to the movable element for the control of the needle and for closing the carburettor body is the partial vacuum prevailing upstream of the butterfly or other throttle valve modulated by an electromagnetic valve controlled by a probe located in the exhaust pipe and supplying a current variable as a function of the exhaust gases.

The present invention relates to improvements in devices of this type.

SUMMARY OF THE INVENTION

The device according to the present invention is a constant vacuum carburettor of the type having a movable element for closing the body of the carburettor carrying the dosing needle and controlled by the partial vacuum prevailing upstream of the butteryfly or throttle valve, via an element such as a piston or a membrane, wherein the needle is arranged to be movable in relation to the movable element for the closure of the carburettor body and it is connected mechanically to the membrane of a capsule having a membrane carried by the said element, this capsule being subject on the one hand to atmospheric pressure and on the other hand to the partial vacuum prevailing upstream of the throttle valve, acting against an elastic return device such as a spring and modulated by an electromagnetic valve controlled by a probe located in the exhaust pipe and supplying a current variable as a function of the composition of the exhaust gases.

The term "second movable element" should be understood as including any device sensitive to a pressure differential between two chambers, such as a membrane or a piston.

Thus the behaviour of the first movable element is not modified in response to variations in the throughput of the carburettor and it is the dosing needle which moves in relation to the first movable element.

Furthermore, it is possible to combine with the indication of the partial vacuum prevailing upstream of the butterfly an indication of the partial vacuum coming from the inlet manifold, in order to cover constantly sufficient levels of energy to activate the needle, even at low rates.

To this end:

a. The pipe connecting the electromagnetic valve to the side of the second movable element at sub-atmospheric pressure is provided with a branch having a constriction opening into the inlet manifold.

b. Non return valves are advantageously arranged on the two branches of the said pipe to avoid interference between them.

The invention further provides that:

c. The side of the second movable element which is subject to the partial vacuum prevailing upstream of the butterfly is connected by a pipe to a buffer reservoir having a communication with the free air controlled by the electromagnetic valve subject to the probe.

d. The needle holder movable in the closure element is designed so as to leave air passages free when the needle holder is in position against the seat of the fuel inlet orifice.

DESCRIPTION OF THE PREFERRED EMBODIMENT

Figure 1:
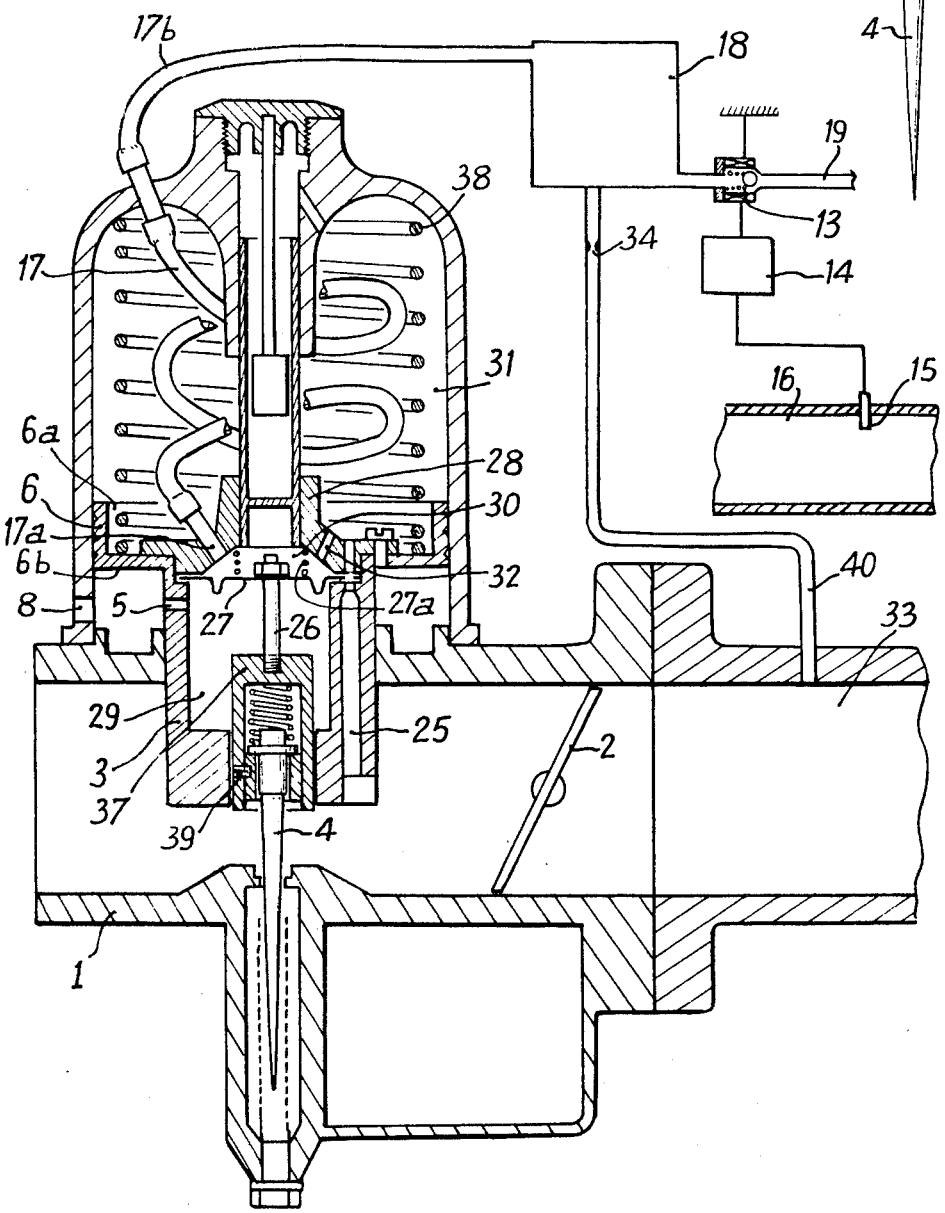
FIG. 1 shows in schematic section an embodiment of the carburettor according to the invention.

By referring to FIG. 1 it can be seen that the carburettor is of the type having a piston 6 movable in the body of the carburettor 1, driving the movable element constituted by the throttle chamber 3 located upstream of the throttle valve 2; the upper face **6*a* of the piston 6 held by the spring 38 being subject to the partial vacuum prevailing in the chamber 31, i.e., to the partial vacuum prevailing upstream of the throttle valve 2, transmitted by duct 25 while the lower face 6*b* of the piston 6 is connected to the atmosphere by the orifice 8**.

According to the present invention, the dosing needle 4 is movable in the interior of the movable element 3; it is connected mechanically by the stem 26 to the movable membrane 27 of the membrane capsule formed by the internal wall of the throttle chamber 3 and the cap 28, the whole being pushed back by the spring **27*a* and communicating with the chamber 31 by the orifice 32**.

Another orifice **17*a* is arranged in the upper cover 38 closing the chamber 30 and this orifice is connected to a flexible tube 17 permitting the free movement of the piston 6**. This flexible tube can be advantageously constituted by a plastics spiral tube resistant to hydrocarbons, temperature and alternating bending.

The partial vacuum prevailing in the chamber 31 therefore also prevails in the chamber 30 and this partial vacuum is modulated in the following way as a function of the composition of the exhaust gases. The chamber 30 is connected via the tube 17 and the pipe **17*b* to the atmosphere at 19, the atmosphere being advantageously drawn through an air filter, with the interposition of the electromagnetic valve 13 subject, via an electronic circuit 14, to electrical information from the probe 15 located in the exhaust pipe 16. When the probe inidicates an excessively rich mixture, the electromagnetic valve 13 opens, causing the partial vacuum prevailing in the chamber 30 to drop and the needle 4 is pushed by the spring 27*a* in the direction of closing without altering the position of the throttle chamber 3. The needle 4 is otherwise normally driven by the movement of the whole of the throttle chamber 3**.

The orifice 32 and the orifice **17*a* or the pipe 17, 17*b*, can be provided with optionally variable throttling devices, permitting the control action of the membrane 27 on the needle 4** to be made more or less rapid according to requirements.

As shown, the needle 4 can be fitted so as to be variable in position in the needle holder 37 by means of the screw 39.

Figure 2:
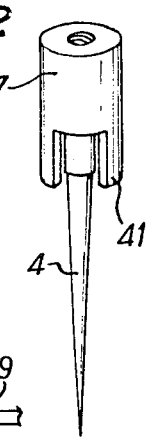
FIG. 2 is a detail view of the needle holder.

When the engine is working on low loads the throttle chamber 3 is only slightly raised and the regulation device orders the needle to descend. The direct contact of the needle holder 37 on the seat of the needle then runs the risk of causing undesirable modifications of the partial vacuum on the fuel inlet orifice. To avoid this disadvantage, the invention provides that the needle holder 37 rests on the seat of the needle 4 by means of extensions 41 which thus leave free passages for air (FIG. 2).

The other provisions of French Patent Application No. 74.30009 apply to the present carburettor, in particular those relating to the buffer reservoir 18, the exhaust duct 19, to the calibration of the pipes, to the means for disconnecting the probe at certain rates, to the nature of the electronic circuit 14.

At certain rates, the partial vacuum available upstream of the throttle valve 2 is very low and the present invention provides for combining it with the partial vacuum prevailing in the manifold to obtain sufficient energy to ensure the movements of the needle 4.

To this effect, a pipe 40 is connected to the pipe 17 or the reservoir 18 from the inlet manifold 33. A restriction 34 permits the regulation of the proportion of the partial vacuum of the manifold which is used in this way as the driving element of the needle 4.

This permits the modulation of the partial vacuum prevailing in the chamber 30 and on the membrane 27 whose action becomes proportional to the air flow.

The present invention is described in relation to a petrol carburettor. Thus it is apparent that it also applies to the same carburettor using any other fuel, whether liquid, solid or gaseous.

Similarly, the invention applies without modification to isobaric carburettors in which the carburettor body closure element is controlled by a membrane subject to the partial vacuum prevailing upstream of the butterfly (playing the same role as the piston 6).

With the device according to the invention, regulation can be effected by the impoverishment of a mixture which is initially too rich or by the enrichment of a mixture which is initially too lean by suitably determining the value of the return force of the spring 27*a* in relation to the other dimensional characteristics of the device.

We claim:

1. A carburetor for an engine having an exhaust pipe comprising:

an air/fuel mixing passage, a throttle valve in said passage, a carburetor body, a first movable element carried by said body and defining a first chamber therewith, a dosing needle carried by said first movable element and operable to increase and decrease the flow of fuel into the air/fuel mixing passage and located upstream of said throttle valve, means for controlling the movement of said first element and displacing said needle including means in communication between said passage and said first chamber at a location along the passage upstream of the throttle valve for creating a partial vacuum in said first chamber, A second movable element carried by and movable relative to said first movable element and defining a second chamber therewith, said dosing needle being carried by said second movable element, means for subjecting the side of said second movable element opposite said second chamber to atmospheric pressure, means in communication between said passage and said second chamber at a location along said passage upstream of said throttle valve for creating a partial vacuum in said second chamber to which said second movable element is subjected and causing said second movable element and said dosing needle to move in a first direction to vary the flow of fuel into the air/fuel mixing passage, means for modulating the partial vacuum in said second chamber including a conduit in communication with said second chamber and open to the atmosphere, a normally closed valve in said conduit, means for disposition in the exhaust pipe for supplying a signal representative of the composition of the exhaust gases and coupled to said valve for opening said valve in response to a predetermined composition thereby to decrease the vacuum in said second chamber and move said second movable element and said dosing needle in a second direction opposite said first direction, a second conduit for connection at one end to the inlet manifold of the engine and at its opposite end to the first mentioned conduit, and means providing a restriction in said second conduit.

2. A carburetor according to claim 1, including a buffer reservoir arranged in said conduit.

3. A carburetor according to claim 1 comprising a holder for said needle and connected to said second movable element, a fuel inlet orifice opposite said needle, said holder having slots forming air passages thereby enabling flow of the fuel/air mixture in said passage when said needle holder seats against said fuel inlet orifice.

4. A carburetor according to claim 1, wherein said second movable element is a membrane.

* * * * *